US006834946B2

(12) United States Patent
McKinnell et al.

(10) Patent No.: US 6,834,946 B2
(45) Date of Patent: Dec. 28, 2004

(54) MECHANISM FOR SUPPLYING INK TO A PORTABLE INK JET PRINTER

(75) Inventors: James C. McKinnell, Salem, OR (US); Thomas E. Pettit, Corvallis, OR (US); Raymond James Ehlers Jr., Corvallis, OR (US); Eric S. Dod, Corvallis, OR (US); Roberta Stinson, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/059,688

(22) Filed: Jan. 28, 2002

(65) Prior Publication Data

US 2003/0142178 A1 Jul. 31, 2003

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS

| | | | | | |
|---|---|---|---|---|---|
| 3,967,286 | A | | 6/1976 | Anderson et al. | 346/140 R |
| 4,484,827 | A | | 11/1984 | Price, Jr. | 401/205 |
| 4,967,207 | A | | 10/1990 | Ruder | 346/140 R |
| 5,182,581 | A | * | 1/1993 | Kashimura et al. | 347/87 |
| 5,365,262 | A | * | 11/1994 | Hattori et al. | 347/87 |
| 5,420,625 | A | | 5/1995 | Dietl et al. | 347/85 |
| 5,430,471 | A | * | 7/1995 | Nakajima et al. | 347/87 |
| 5,519,425 | A | | 5/1996 | Dietl et al. | 347/87 |
| 5,703,633 | A | | 12/1997 | Gebrer et al. | 347/86 |
| 5,831,653 | A | | 11/1998 | Brandon et al. | 347/87 |
| 5,841,455 | A | | 11/1998 | Tanaka et al. | 347/87 |
| 5,949,458 | A | | 9/1999 | Studholme | 347/86 |
| 5,971,643 | A | | 10/1999 | Ahmed | 401/44 |
| 6,059,403 | A | | 5/2000 | Burgin | 347/87 |
| 6,142,618 | A | | 11/2000 | Smith et al. | 347/85 |
| 6,164,770 | A | | 12/2000 | Takata | 347/86 |
| 6,254,226 | B1 | | 7/2001 | Lengyel et al. | 347/86 |
| 6,270,207 | B1 | * | 8/2001 | Sasaki | 347/86 |
| 6,276,780 | B1 | | 8/2001 | Carrese et al. | 347/49 |
| 6,450,630 | B2 | | 9/2002 | Kanaya et al. | |

FOREIGN PATENT DOCUMENTS

| | | | | |
|---|---|---|---|---|
| EP | 0 091 561 | | 10/1983 | |
| EP | 0490579 | A2 * | 5/1991 | B41J/2/175 |
| EP | 0 490 579 | A2 | 6/1992 | |
| EP | 1 020 293 | A1 | 7/2000 | |
| WO | WO 00/05073 | | 2/2000 | |

OTHER PUBLICATIONS

Eberhardt et al., "Superfluid Helium On Orbit Resupply", Advances in Cryogenic Engineering, vol. 35, pp. 311–320.

* cited by examiner

*Primary Examiner*—Anh T. N. Vo

(57) ABSTRACT

An ink jet cartridge is provided comprising an outlet port, an ink containing region, and a wick substantially surrounding a portion of the ink containing region, the wick being configured such that ink flows to the outlet port. Preferably, the wick is configured such that ink flows to the outlet port irrespective of an orientation of the ink jet cartridge.

21 Claims, 5 Drawing Sheets

MECHANISM FOR SUPPLYING INK TO A PORTABLE INK JET PRINTER

BACKGROUND OF THE INVENTION

A. Field of the Invention

The invention relates generally to ink supplies, more particularly, to ink jet cartridges for portable ink jet printers having a wick positioned such that ink is supplied to an outlet irrespective of the orientation of the ink jet cartridge.

B. Background of the Invention

Ink jet printers are commonly used as printing sources for business and personal use. Increasingly, ink jet printers are being used in portable printing applications, such as portable ink jet printers for travelers. The Canon BJC80® and HP Deskjet 350C® are two exemplary portable ink jet printers. Ink jet printers (especially portable ink jet printers) currently suffer from problems due to inconsistent ink supply that vary based on the position and/or orientation of the printer.

Conventional ink jet printers can typically be operated in only one position. Consequently, conventional ink jet cartridges are designed to substantially facilitate ink flow based on a single ink jet cartridge orientation within a given printer. It follows that turning a conventional ink jet printer upside down or on a side often prevents the ink jet printer from functioning properly. By way of example, a vertical ink jet cartridge may facilitate ink flow from the sides of the ink cartridge to a centrally located outlet port on the bottom of the ink jet cartridge by employing a wick that draws ink from the sides of the ink cartridge towards the outlet port. Gravity draws ink from top to bottom in the cartridge, such that so long as the ink jet cartridge is not flipped upside down, the ink will flow properly to the outlet port.

Many users, however, need printers that will function properly in several positions or orientations. By way of example, a user may want to print a document with a palmtop computer, such as a Cassiopeia®. Further, photographers may want to print a document with a digital camera, such as a Canon Sureshot®. The palmtop and/or digital camera may be fitted with a stand-alone portable printer, or an integral printer within the palmtop or digital camera itself. The printer (or palmtop/digital camera with integral printer) may be positioned upright on a tray table, or may be turned on a side as the user handles the device. Other common applications involve portable printers for laptop computers which may be positioned upright, or on a side depending on the space available. Conventional ink jet printers, which have ink jet cartridges designed to substantially function in only one position, are not able to supply a sufficient amount of ink to print properly in alternate positions and/or orientations. Hence, a need exists for an ink jet cartridge that can substantially supply ink irrespective of the position and/or orientation of the ink jet cartridge.

Furthermore, different printers require individual ink jet cartridge configurations due to varying printhead layouts. By way of example, a non-portable printer with a horizontal printhead may need ink supplied horizontally (e.g., from right to left), while a non-portable printer with a vertical printhead may need ink supplied vertically (e.g., from top to bottom). Conventional ink jet cartridges that are designed to supply ink in one orientation could not be used for both printers. Hence, a need exists for an ink jet cartridge that can be used in a plurality of printers with different respective printhead orientations.

SUMMARY OF THE INVENTION

The present invention is directed to overcoming or at least reducing the effects of one or more of the problems set forth above and other problems in the prior art.

According to one aspect of the present invention, an ink jet cartridge is provided comprising an outlet port, an ink containing region, and a wick substantially surrounding at least a portion of the ink containing region, the wick being configured such that ink flows to the outlet port. Preferably, the wick is configured such that ink flows to the outlet port irrespective of an orientation of the ink jet cartridge.

According to another aspect of the present invention, the ink containing region is insert free.

According to another aspect of the present invention, the ink jet cartridge further comprises a foam insert positioned within the ink containing region.

According to another aspect of the present invention, the wick is substantially strip shaped.

According to another aspect of the present invention, the wick has a width less than the width of the ink containing region.

According to another aspect of the present invention, the wick has capillary action such that ink is supplied to a feed to allow printing.

According to another aspect of the present invention, a method of supplying ink to an ink jet printer is provided comprising the steps of providing an ink cartridge containing ink in a containing region and a wick substantially surrounding at least a portion of the containing region, and drawing ink to an outlet port through the wick. Preferably, the step of drawing ink to an outlet port through the wick draws ink irrespective of an orientation of the ink cartridge.

According to another aspect of the present invention, a method of supplying ink to an ink jet printer further comprises a step of subjecting ink to a negative pressure.

According to another aspect of the present invention, an ink jet ink cartridge is provided comprising an outlet port, a shell, and a wick positioned along the internal periphery of the shell and substantially surrounding a foam free internal region, the wick being configured such that ink flows to the outlet port irrespective of an orientation of the ink jet cartridge. Preferably, the wick has capillary action such that ink is supplied to a feed to allow printing.

BRIEF DESCRIPTION OF THE DRAWINGS

The foregoing advantages and features of the invention will become apparent upon reference to the following detailed description and the accompanying drawings, of which.

DETAILED DESCRIPTION OF SPECIFIC EMBODIMENTS

Reference will now be made in detail to presently preferred embodiments of the invention. Wherever possible, the same reference numbers will be used throughout the drawings to refer to the same or like parts.

Figure 1:
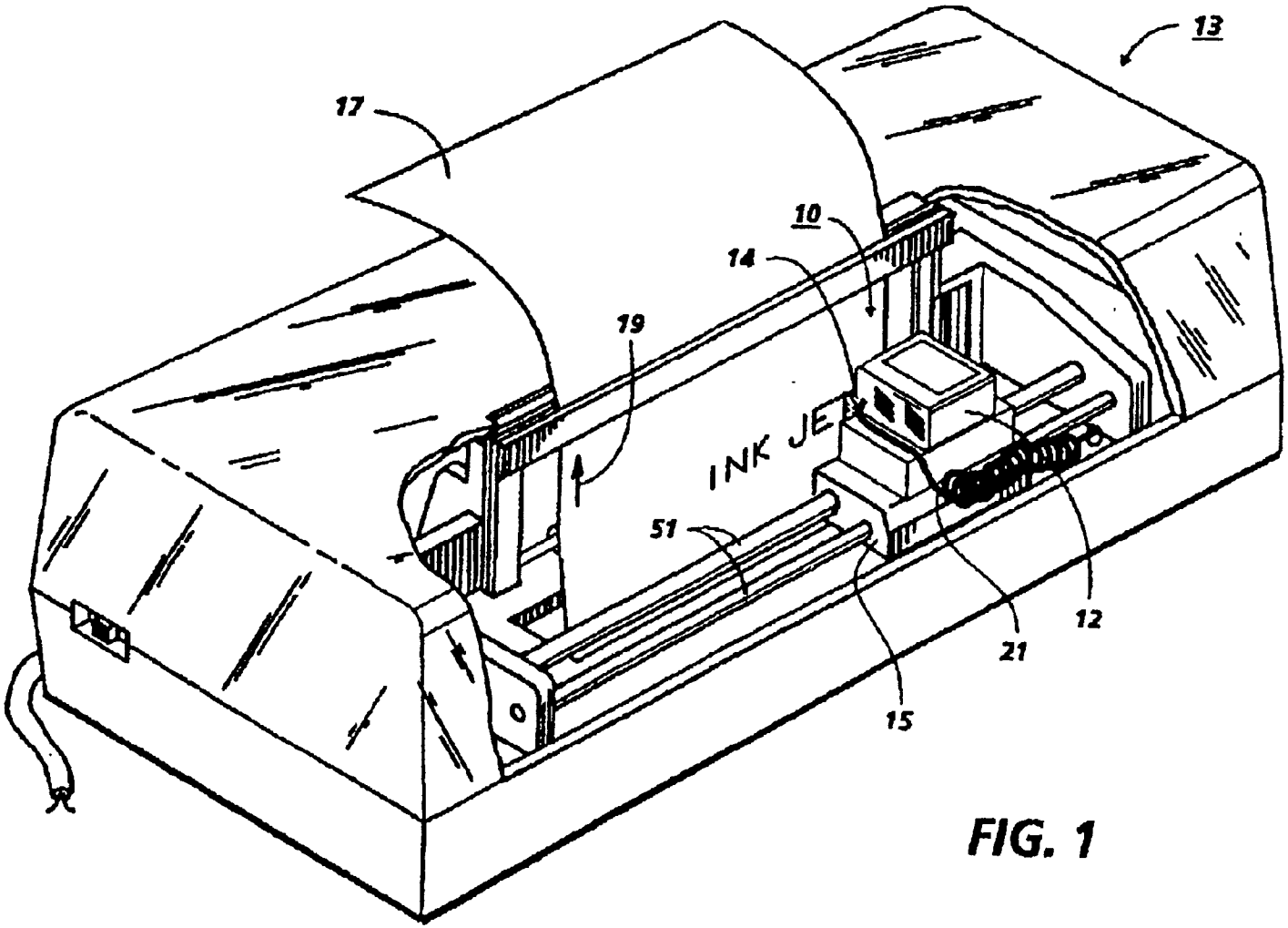
FIG. 1 is an elevational block diagram of an exemplary ink jet printer according to the present invention.

A general elevational view of an exemplary ink jet printer 13 having a printing assembly 10 is shown by the block diagram of FIG. 1. The printing assembly 10 moves back and forth along shafts 51 relative to the sheet 17 to print characters 14 across the sheet 17. The printing assembly 10 comprises a printhead 12 and an ink jet cartridge 21. The present invention is directed at improvements in the printing assembly 10, specifically the ink jet cartridge 21 and printhead 12. As would be readily apparent to one skilled in the art, many other ink jet printer configurations may be used in combination with the present invention, such as an ink jet printer having a combined printhead/ink jet cartridge.

Figure 2:
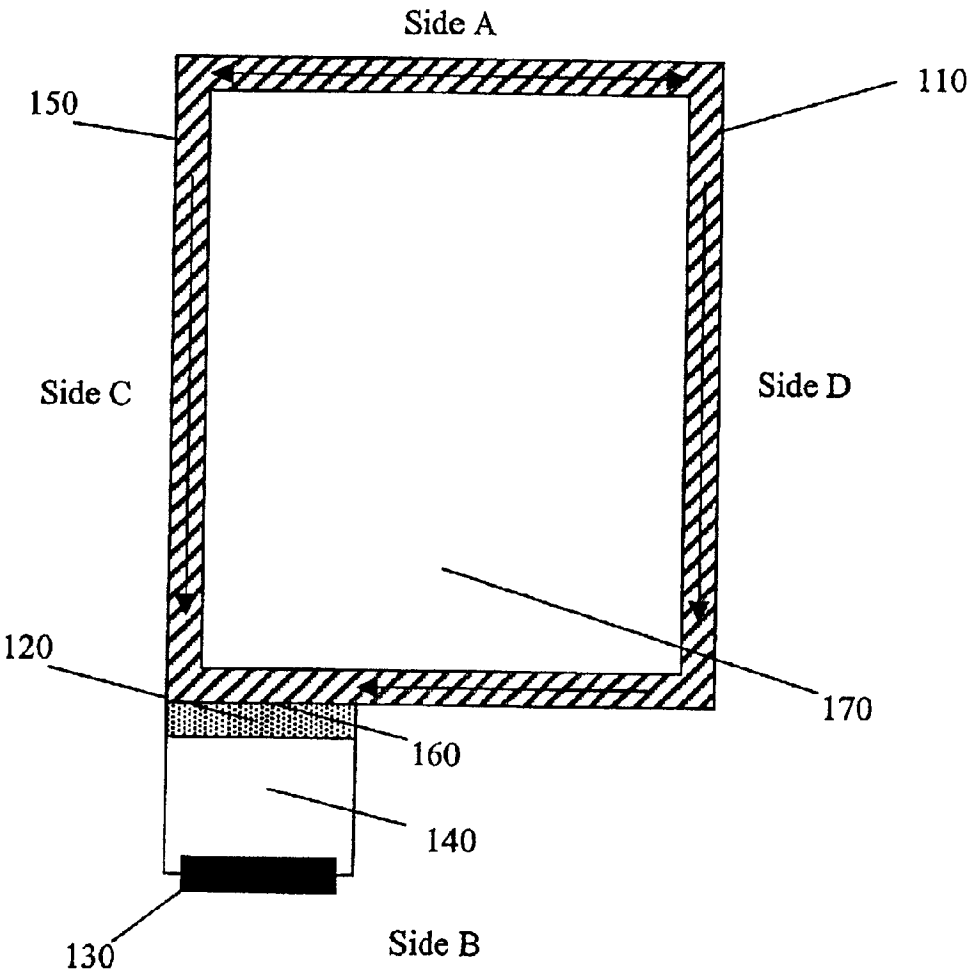
FIG. 2 is a sectional block diagram of a first embodiment of an ink jet cartridge according to the present invention.

A first embodiment of an ink jet cartridge according to the present invention is shown by the block diagram of FIG. 2. According to this first embodiment, the ink jet cartridge comprises a shell 110 having a port 160, a filter 120, and a wick 150 positioned within the shell 110. Preferably, the ink jet cartridge further comprises a feed 140 for supplying ink to a printhead 130.

By way of example but not by way of limitation, the ink jet cartridge is shown with four sides A–D. As shown in FIG. 2, Side A is the top, Side B the bottom, Side C the left, and Side D the right of the ink jet cartridge. The wick 150 according to the present invention is configured such that ink contained within the ink containing region 170 flows in the direction of the outlet 160 on Side B. Preferably, the ink containing region 170 is subjected to a negative pressure to facilitate ink flow within the ink jet cartridge.

According to this first embodiment, wick 150 substantially surrounds a portion of the ink containing region 170. The wick 150 may substantially surround all of the ink containing region 170 or may include breaks and/or gaps in some areas. It follows that any one of the sides A–D may include a gap (not shown) in wick 150 for performing operations such as venting the ink containing region 170 and/or filling the ink cartridge. Further, the wick 150 may be omitted entirely on one of sides A–D of the ink jet cartridge as the ink jet cartridge will still function to supply a sufficient amount of ink to the outlet port 160 for printing without a wick 150 on all of sides A–D.

If the ink jet cartridge is rotated, for example rotating the ink jet cartridge such that Side C is the top, Side D the bottom, Side B the left, and Side A the right of the ink jet cartridge, ink still flows in the direction of the outlet 160 on Side B. It should be appreciated that any position and/or orientation of the ink jet cartridge will have a similar effect. Hence, an ink jet cartridge according to the present invention has the advantage of substantially supplying ink to the outlet port 160 irrespective of the orientation of the ink jet cartridge. Moreover, an ink jet cartridge according to this first embodiment can substantially supply ink to the printhead 130 even when the ink level within the cartridge is very low, as at least a portion of the wick 150 remains in contact with the ink even at a relatively low ink level.

Unlike many conventional ink jet cartridges, an ink jet cartridge according to the present invention does not require that the ink supply 110 be filled with a foam insert in ink containing region 170, thereby providing additional ink storing capacity with insert free configurations. Alternatively, a foam insert may be provided in ink containing region 170 to substantially reduce air bubbles within the ink containing region 170 and/or to improve contact with the wick 150. By way of example, foam inserts made of a continuous fine porous material such as polyurethane or the like having sufficient elasticity and liquid absorbing properties may be used.

Figure 3:
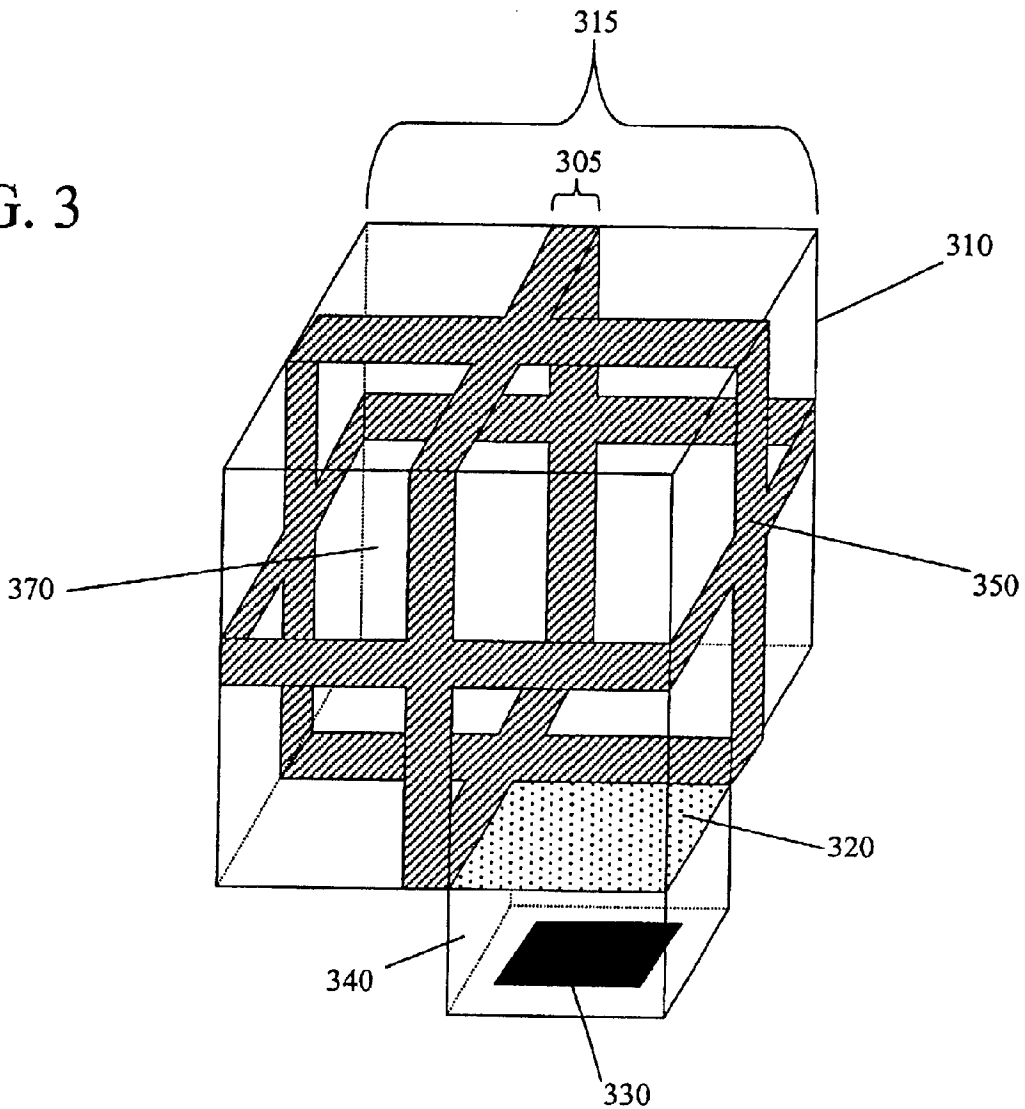
FIG. 3 is a block diagram of a second embodiment of an ink jet cartridge according to the present invention.

A second embodiment of an ink jet cartridge according to the present invention is shown by the block diagram of FIG. 3. An ink jet cartridge according to this second embodiment is similar to the first embodiment, hence only the differences will be described below in detail.

According to this second embodiment, the ink jet cartridge comprises a shell 310 having an outlet port at the filter 320. Wick 350 is positioned along the internal periphery of the shell 310 and substantially surrounds a portion of the ink containing region 370. Similar to a first embodiment of the present invention, the wick 350 is configured such that ink is supplied to the outlet port. The wick 350 may be omitted in portions and/or entirely on any one of the sides depending on the implementation so long as ink is still supplied to the outlet port.

As shown in this embodiment, the wick 350 is substantially strip shaped, the width 305 of the wick 350 being less than the width 315 of the ink containing region 370. An ink jet cartridge having a strip shaped wick 350 has the advantage of using less wicking material than other configurations, while still supplying ink to the printhead 330 irrespective of an orientation of the ink jet cartridge. Moreover, space adjacent to the wick 350 can be left open for implementing venting regions, filling regions, and other common ink jet cartridge components that may be required.

Figure 4:
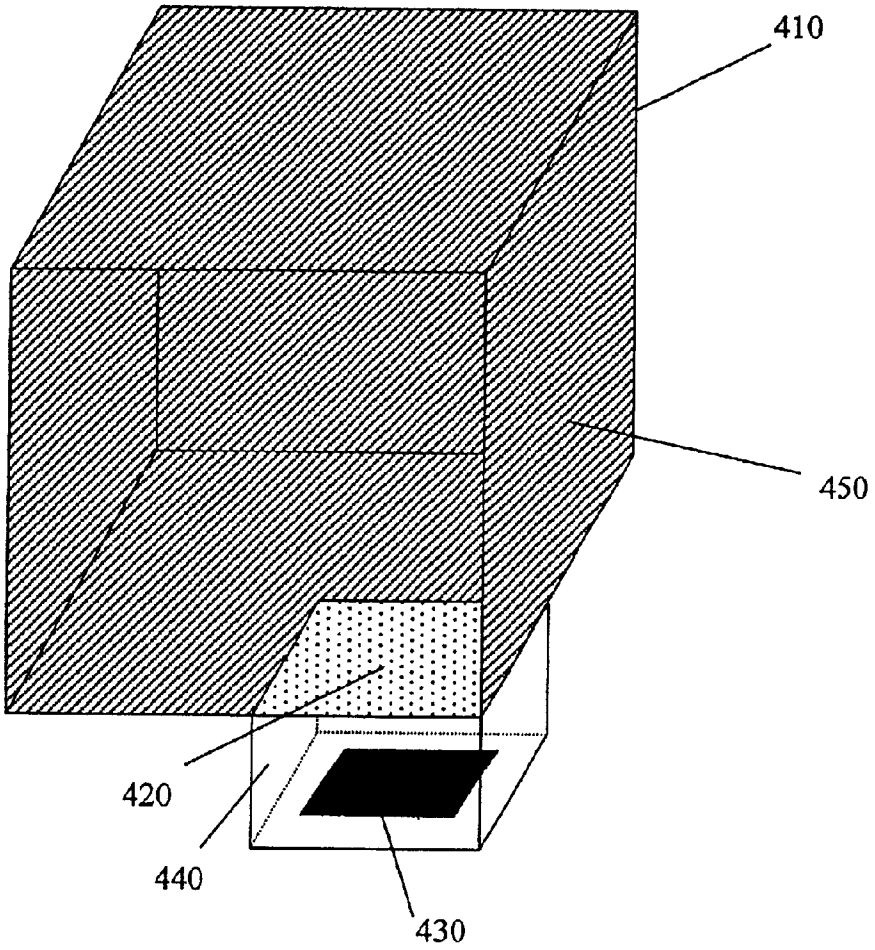
FIG. 4 is a block diagram of a third embodiment of an ink jet cartridge according to the present invention.

A third embodiment of an ink jet cartridge according to the present invention is shown by the block diagram of FIG. 4. An ink jet cartridge according to this third embodiment is similar to the first embodiment, hence only the differences will be described below in detail.

According to this third embodiment, the ink jet cartridge comprises a shell 410 having an outlet port at the filter 420. Wick 450 is positioned along the internal periphery of the shell 410 and substantially surrounds a portion of the ink containing region. Wick 450 may completely surround the ink containing region, or may have gaps and/or portions omitted as previously described with respect to a first embodiment of the present invention. By way of example but not by way of limitation, as shown in FIG. 4 the wick 450 is omitted on the side facing the reader.

The wick 450 according to this third embodiment is substantially sheet shaped, conforming to the interior surface of the shell 410. An ink jet cartridge having a substantially sheet shaped wick 450 is simple to manufacture in addition to all of the advantages of the first embodiment. Sheet(s) of wicking material that conform to the interior surface of the shell 410 can be readily applied to the interior periphery of the shell 410 without substantially adding to the cost of the ink jet cartridge. Further, a pre-formed substantially bag shaped wicking material may be placed within the ink jet cartridge similar to the sheet application shown in FIG. 4.

Figure 5:
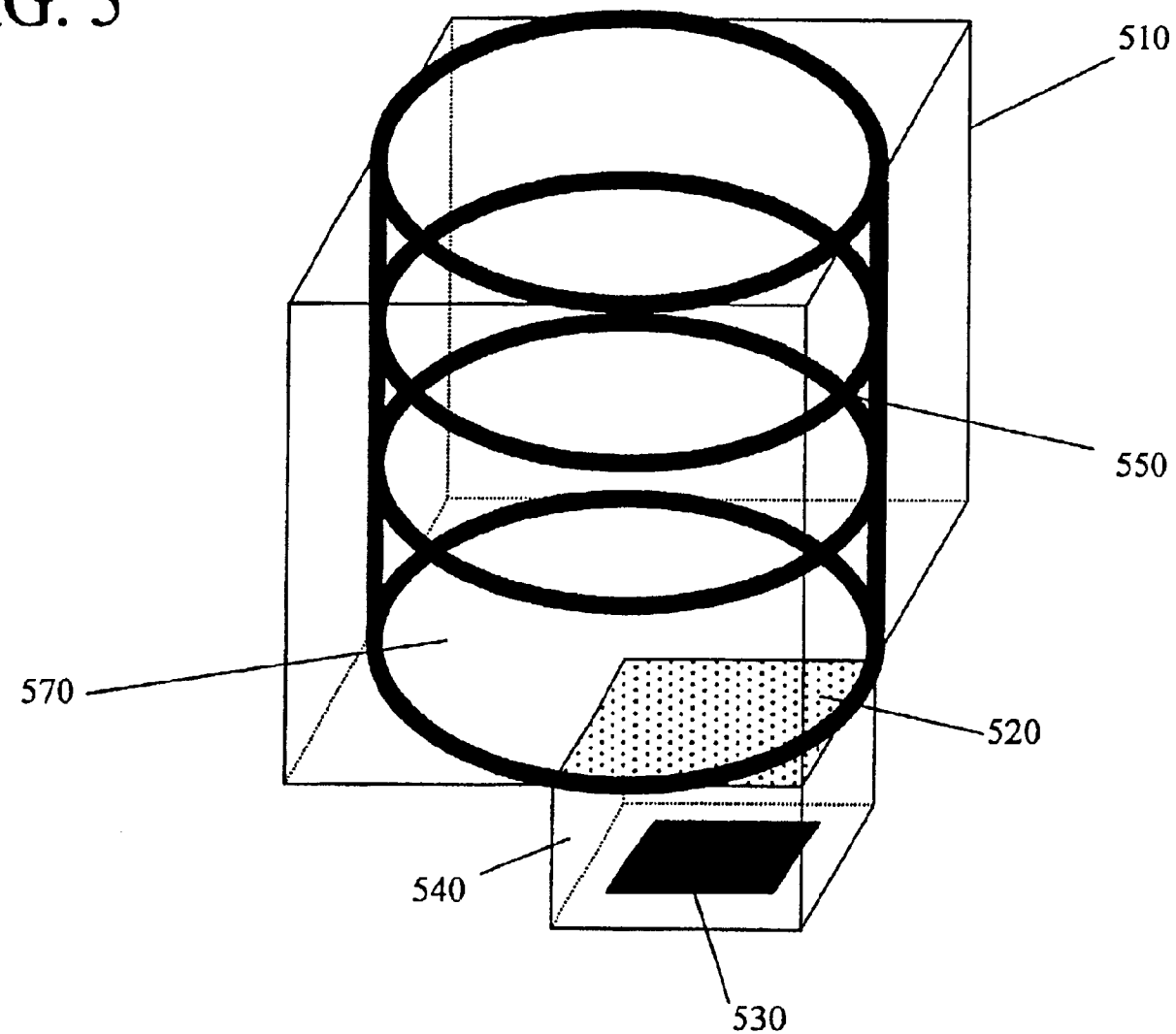
FIG. 5 is a block diagram of a fourth embodiment of an ink jet cartridge according to the present invention.

A fourth embodiment of an ink jet cartridge according to the present invention is shown by the block diagram of FIG. 5. An ink jet cartridge according to this fourth embodiment is similar to the first embodiment, hence only the differences will be described below in detail.

According to this fourth embodiment, the ink jet cartridge comprises a shell 510 having an outlet port at the filter 520. A wick 550 is provided such that sufficient ink is supplied to the printhead 530 via feed 540. The wick 550 according to this fourth embodiment may, in some designs, be positioned such that the wick 550 does not contact a periphery of the shell 510, but substantially surrounds an ink containing region (not shown).

As shown in FIG. 5, the wick 550 according to this fourth embodiment is substantially ring shaped. The ring may be circular, ovular, hexagonal, or take on any other geometry as would be readily apparent to one skilled in the art. The ring is configured such that the wick substantially surrounds a portion of the ink containing region 570 and that sufficient ink is supplied to the printhead 530 irrespective of an orientation of the ink jet cartridge.

An ink jet cartridge according to this fourth embodiment provides flexibility for a variety of particular configurations and has all of the advantages of a first embodiment of the present invention. A ring configuration allows for use of pre-existing wicks comprising bundled fibers without substantial modification. Further, the ring may be configured to optimize ink flow in a particular direction. As would be readily apparent to one skilled in the art, the particular number of rings and configuration of the rings will vary based on implementation. Hence, the configuration shown in FIG. 5 is exemplary only, and is not limiting on the scope of the invention.

According to any one of the aforementioned embodiments of the present invention, the wick preferably comprises a material having sufficient capillary action such that sufficient ink is supplied to a feed to allow printing. Compressed and/or bundled fibers and other methods of creating wicks with sufficient capillary action are well known in the art. Alternatively, the wick may comprise open cell foam, sintered powders (metal, ceramic or powder), pressed plastic or porous wall tube filled with powder.

Thus, an ink jet cartridge having a wick has been described according to the present invention. Many modifications and variations may be made to the techniques and structures described and illustrated herein without departing from the spirit and scope of the invention. Accordingly, it should be understood that the methods and apparatus described herein are illustrative only and are not limiting upon the scope of the invention.

The foregoing description of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet cartridge comprising:

a shell having an outlet port and enclosing an ink containing region; and a wick disposed within the shell and substantially surrounding at least a portion of said ink containing region, said wick being configured such that it leaves a hollow within the shell and spans all sides of the shell so that ink flows from the hollow to the outlet port irrespective of the jet cartridge being either one of laid on its side and inverted.

2. The ink jet cartridge of claim 1, wherein the ink containing region is insert free.

3. The ink jet cartridge of claim 1, wherein the ink containing region comprises a negatively pressurized region.

4. The ink jet cartridge of claim 1, wherein the wick has capillary action such that ink is supplied to a feed to allow printing.

5. The ink jet cartridge of claim 1, further comprising a foam insert disposed in the hollow.

6. An ink jet cartridge comprising:

a shell having an outlet port;

an ink containing region within the shell; and a wick substantially surrounding at least a portion of said ink containing region, said wick being configured such that ink flows to the outlet port, the wick comprising at least two rectangular strip-shaped members which intersect each other at a predetermined angle.

7. The ink jet cartridge of claim 6, wherein the at least two rectangular strip-shaped members each have a width less than the width of the ink containing region.

8. The ink jet cartridge of claim 6, wherein the wick is positioned adjacent to an internal surface of said shell.

9. The ink jet cartridge of claim 6, wherein the predetermined angle is approximately 90°.

10. An Ink jet cartridge comprising:

an ink containing region which communicates with an outlet port;

a wick substantially surrounding at least a portion of said ink containing region, said wick being configured such that ink flows to the outlet port; and a foam insert positioned within said ink containing region.

11. An ink jet cartridge comprising:

an outlet port;

an ink containing region; and a wick substantially surrounding at least a portion of said ink containing region, said wick being configured such that ink flows to the outlet port;

wherein the wick is annular.

12. A method of supplying ink to an ink jet printer comprising the steps of:

disposing a wick in a shell of an ink cartridge configured to contain ink in a containing region, and arranging the wick to substantially surrounding at least a portion of said containing region and to span all sides of the shell so as to enable ink to be drawn to and outlet port in the shell irrespective of whether the ink cartridge is laid on its side or inverted.

13. The method of claim 12, further comprising disposing a foam insert within the containing region.

14. The method of claim 12, wherein the containing region is maintained insert free.

15. The method of claim 12, further comprising a step of subjecting ink in the containing region to a negative pressure.

16. The method of claim 12, further comprising configuring the at least two rectangular strip-shaped members to each have a width less than the width of the containing region.

17. The method of claim 12, wherein the wick has capillary action such that ink is supplied to a feed to allow printing.

18. The method of claim 12, wherein the step of drawing ink to an outlet port through the wick draws ink irrespective of whether the ink cartridge is laid on its side or inverted.

19. A method of supplying ink to an ink jet printer comprising the steps of:

providing an ink cartridge containing ink in a containing region and a wick substantially surrounding at least a portion of said containing region;

drawing ink to an outlet port through the wick; and configuring the wick to be annular.

20. A method of supplying ink to an ink jet printer comprising the steps of:

providing an ink cartridge containing ink in a containing region and a wick substantially surrounding at least a portion of said containing region;

drawing ink to an outlet port through the wick; and configuring the wick to comprise at least two rectangular strip-shaped members which intersect each other at a predetermined angle.

21. The method of claim 20, wherein the predetermined angle is approximately 90°.

* * * * *

UNITED STATES PATENT AND TRADEMARK OFFICE

CERTIFICATE OF CORRECTION

PATENT NO. : 6,834,946 B2
DATED : December 28, 2004
INVENTOR(S) : McKinnell et al.

It is certified that error appears in the above-identified patent and that said Letters Patent is hereby corrected as shown below:

Column 6,
Line 16, delete “Ink” and insert therefor -- ink --.

Signed and Sealed this

Twenty-eighth Day of June, 2005

JON W. DUDAS
*Director of the United States Patent and Trademark Office*